US005459376A

United States Patent [19]

Buij et al.

[11] Patent Number: 5,459,376

[45] Date of Patent: Oct. 17, 1995

[54] PROGRAMMABLE LIGHTING SYSTEM WITH AUTOMATIC LIGHT CONTROL OF AMBIENT AREAS

[75] Inventors: Arnold W. Buij; Marcel Beij, both of Eindhoven, Netherlands

[73] Assignee: U. S. Philips Corporation, New York, N.Y.

[21] Appl. No.: 169,820

[22] Filed: Dec. 17, 1993

[30] Foreign Application Priority Data

Dec. 21, 1992 [EP] European Pat. Off. ..... 92204036

[51] Int. Cl.[6] ..... H05B 41/36

[52] U.S. Cl. ..... 315/297; 315/158; 315/DIG. 4

[58] Field of Search ..... 315/291, 292, 315/294, 297, 307, 308, 309, 316, 315, 324, 151, 158, DIG. 4, 295, 154, 157, 159, 155; 250/214 AL

[56] References Cited

U.S. PATENT DOCUMENTS 5,015,924 5/1991 Berman et al. ..... 315/324
5,128,594 7/1992 Watanabe et al. ..... 315/294

FOREIGN PATENT DOCUMENTS 0482680 4/1992 European Pat. Off. .

*Primary Examiner*—Ali Neyzari
*Attorney, Agent, or Firm*—Edward Blocker; Bernard Franzblau

[57] ABSTRACT

A lighting system comprising lighting units each provided with a lamp and a control device for controlling the luminous fluxes of the lamps. The control device includes a first adjustment device (II) for selecting a lighting mode of the lighting system and a further adjustment device (III) for changing a desired luminous flux value in a chosen location illuminated by at least one lighting unit of a first group of the lighting units within a lighting mode. The system is also provided with a correction device (IV) for automatically changing the luminous fluxes of the lighting units of a second group of lighting units dependent upon a change in the desired luminous flux value at the chosen location. In the case of a change in the task lighting by the user (the luminous flux of a first group of lighting units), the surround lighting (the luminous flux of the second group of light units) is changed so that a good harmony between task lighting and surround lighting is maintained.

21 Claims, 2 Drawing Sheets

PROGRAMMABLE LIGHTING SYSTEM WITH AUTOMATIC LIGHT CONTROL OF AMBIENT AREAS

FIELD OF THE INVENTION

This invention relates to a lighting system comprising lighting units, each provided with connection terminals for holding at least one lamp, an operating circuit for operating the lamp, a control circuit coupled to the operating circuit for controlling the luminous flux of the lamp, a control device for influencing the luminous fluxes of the lamps via the respective control circuits, comprising a first adjustment device for selecting a lighting mode of the lighting system, a further adjustment device for changing a desired luminous flux value within a lighting mode at at least one chosen location which is illuminated by at least one lighting unit belonging to a first group of the lighting units.

BACKGROUND OF THE INVENTION

Such a lighting system is known from European Patent Application EP 482680 A1. A lighting mode of the known lighting system is associated with a certain spatial distribution of the light in the room in which the lighting system is installed. A user of the known lighting system can adapt the illumination of the room in which the lighting system is installed to his activities such as, for example, reading, watching TV, etc, through the choice of a suitable lighting mode. When a certain lighting mode has been set, the tint group of lighting units often supplies a comparatively high luminous flux intended for task lighting at the chosen location, while the luminous fluxes of the other lighting units belonging to a second group supply surround lighting. Often, lighting modes can also be selected attuned to situations in which more than one person uses the room. The different persons will in general perform different tasks in different locations. In such situations, two or more chosen locations are present in the room, a task lighting being realized in each chosen location which suits the task to be performed in this location. It is desirable for the surround lighting to be harmonized with the task lighting so that the overall illumination of the room makes a pleasant impression on the human eye. This harmonization means that the luminous flux of the surround lighting must be chosen within a certain range, which range depends on the luminous flux value(s) in the chosen location(s). The lighting modes, moreover, are programmable in the known lighting system. This renders it possible to program lighting modes for widely differing rooms and for widely differing tasks, the surround lighting being harmonized with the task lighting. This harmonization, however, is lost when a user changes the desired luminous flux value in one or several locations by means of the further adjustment device within a given lighting mode without adapting the luminous flux of the second group of lighting units. This means that one of the main advantages of a lighting system with preprogrammed lighting modes may easily be lost when the system also offers the user the possibility of adjusting the luminous flux for task lighting in accordance with his own preference and/or needs.

SUMMARY OF THE INVENTION

An object of the invention is to provide, inter alia a lighting system in which the user can adjust the desired luminous flux value in a chosen location over a wide range according to his preference and/or needs within a given lighting mode, while within this range a good harmonization of the surround lighting with the task lighting is maintained.

According to the invention, a lighting system of the kind mentioned in the opening paragraph is for this purpose characterized in that the control device is further provided with a correction device for automatically changing the luminous fluxes of the lighting units which make up the second group of lighting units in dependence on a change in the desired luminous flux value in the chosen location.

The surround lighting is adapted to the task lighting over a substantial portion of the adjustment range of the task lighting owing to the automatic adaptation of the luminous fluxes of the second group of lighting units upon a change in the desired luminous flux value in the chosen location.

When the lighting system according to the invention is installed in a room where there is no light other than the light generated by the lighting units, a luminous flux substantially equal to the desired luminous flux value is generated in the chosen location substantially exclusively by the relevant lighting unit(s) which make up the first group. When the luminous flux in the chosen location is not substantially exclusively determined by the luminous flux(es) from lighting units belonging to the first group, however, but also by daylight, it is advantageous to provide the lighting system with a control system for rendering the total luminous flux built up from the luminous flux of daylight and the luminous flux(es) of the lighting units of the first group substantially equal to the desired luminous flux value in the chosen location, independently of the luminous flux of daylight. As a result, the luminous flux in the chosen location remains substantially constant in spite of fluctuations in the luminous flux of daylight in the chosen location. When all of the lighting units which can belong to the second group, depending on the selected lighting mode, are also provided with such a control system, the surround lighting is also to a high degree independent of the luminous flux of daylight in every lighting mode. Such a lighting system, however, is comparatively expensive. A less expensive possibility is to provide exclusively those lighting units which can belong to the first group, depending on the selected lighting mode, with a control system, and at the same time to set the luminous flux of each lighting unit forming a part of the second group for the lowest value in the range over which the luminous flux of this lighting unit in a given task lighting provides a surround lighting adapted to this task lighting. When the luminous flux of a lighting unit forming part of the second group is supplemented with daylight, a good harmonization between task lighting and surround lighting will only be lost if the total luminous flux is greater than the upper limit of the range referred to above. This means in practice that the harmonization between task lighting and surround lighting is not disturbed even with a comparatively large contribution of the daylight to the surround lighting.

An advantageous embodiment of a lighting system according to the invention is characterized in that the correction means comprise a memory for storing a chosen relation between the desired luminous flux in the chosen location and the luminous fluxes of the lighting units of the second group for each lighting mode of the lighting system. The correction device can be constructed in a reliable and comparatively simple manner through the use of such a memory. Preferably, the memory comprises, for each lighting unit of the second group and for each desired luminous flux value in each chosen location, information about a luminous flux range of the lighting unit of the second group, and the correction device is provided with a device for adjusting the luminous flux of each lighting unit of the second group to a value which belongs to each of the luminous flux ranges of the lighting unit in the case of a change in the desired luminous flux value in a chosen location. When these luminous flux ranges of each of the lighting units of the second group are chosen so that a user experiences the luminous flux of the relevant lighting unit of the second group in the relevant chosen location as pleasant within each range, the adjustment of the luminous flux of the relevant lighting unit of the second group to a value belonging to each range will guarantee that each user of the room experiences this luminous flux as pleasant. When the correction device is also provided with a device for determining the lowest luminous flux value of each lighting unit of the second group which forms part of all luminous flux ranges of the lighting unit, the luminous flux of the lighting unit may be set for this lowest value so that a surround lighting is realized which is well harmonized with the task lighting at a comparatively low power consumption. The advantage described above is also achieved, i.e. the harmonization between task lighting and surround lighting is not disturbed even in the case of a comparatively large contribution of daylight to the surround lighting.

A further advantageous embodiment of a lighting system according to the invention is characterized in that the luminous flux of each lighting unit only can be set for a number of discrete values. Since the desired luminous flux in the chosen location can only be set for a finite number of discrete levels only in this further advantageous embodiment of a lighting system according to the invention, the correction device has to know the desired relation between task lighting and surround lighting only for this finite number of discrete levels, so that the correction device can be of a comparatively simple construction. When the correction device comprises a memory, the desired relation between task lighting and surround lighting may be laid down in this memory in a comparatively simple manner in the form of a table. When the number of discrete levels is chosen to be sufficiently great, the adjustment possibility of the task lighting in practical terms is scarcely more limited than in a lighting system in which the task lighting can be varied continuously. It can also be achieved through a logarithmic increase of the luminous flux with the discrete levels that the change in luminous flux between two consecutive levels is experienced as constant by a user.

Another advantageous embodiment of a lighting system according to the invention is characterized in that the control device comprises a first programming device for programming a desired relation between the desired luminous flux in the chosen location and the luminous fluxes of the second group of lighting units for each lighting mode of the lighting system. The chosen relation between task lighting and surround lighting may be adapted to the room in which the lighting system is installed and to the use of this room as a result of this programming feature. This renders the lighting system highly suitable for use in rooms of differing dimensions and widely differing purposes.

Another embodiment of a lighting system according to the invention, which has very wide application possibilities, is characterized in that the control device comprises further programming means for allocating a lighting unit to one of the groups of lighting units for each lighting mode. This further programming device renders it possible to select the lighting units belonging to the first group or to the second group over a wide range at will, for a given total number of lighting units forming part of the lighting system, whereby widely differing lighting modes can be programmed. In addition, these further programming means offer the possibility of adapting the total number of lighting units which form a part of the lighting system. The possibilities of adjusting the lighting system optimally to the dimensions and intended use of the space in which it is used, during installation or at a later stage, are additionally widened by this further programming device.

When the control device comprises a device for infrared communication between a user and the first and further adjustment device, a user of the lighting system can adjust a lighting mode in a comparatively simple manner and change the luminous flux(es) of one or several lighting units of the first group within a lighting mode. When communication between the user and the first and/or further programming device is also possible through the infrared communication device, a (re)installation of the lighting system by a user can be carried out in a comparatively simple manner as well. To ensure that the infrared signals satisfactorily penetrate the entire room in which the lighting system is accommodated, it may be desirable that the infrared communication means include repetition means for receiving infrared signals and for subsequently transmitting said signals in an unchanged form.

It is also advantageous when the control device includes a device for communication with a further control device for controlling the illumination of a group of rooms. This group of rooms may be formed, for example, by the building in which the room containing the lighting system according to the invention is present. Since the control device communicates with the further control device, the lighting mode of the room in which the lighting system according to the invention is present is partly determined by the further control device which control the illumination of the building. The application possibility of the lighting system according to the invention is thus expanded to rooms in buildings in which the lighting is controlled by a "building management system", which name is often given to this further control device.

It is also possible in a comparatively simple manner to couple the control means to a presence detection system for changing the lighting mode of the lighting system through the control means in the case in which nobody has been present in the room for an adjustable time interval. The change in the lighting mode may consist, for example, in switching-off of the lighting system or in the switching-on of a lighting mode in which the luminous fluxes of a number of lighting units are substantially zero or comparatively low. It is achieved by this that the lighting system consumes comparatively little electric power when the room is not in use.

BRIEF DESCRIPTION OF THE PREFERRED EMBODIMENTS

Embodiments of the invention will be explained in greater detail with reference to the accompanying drawing, in which.

Figure 1:
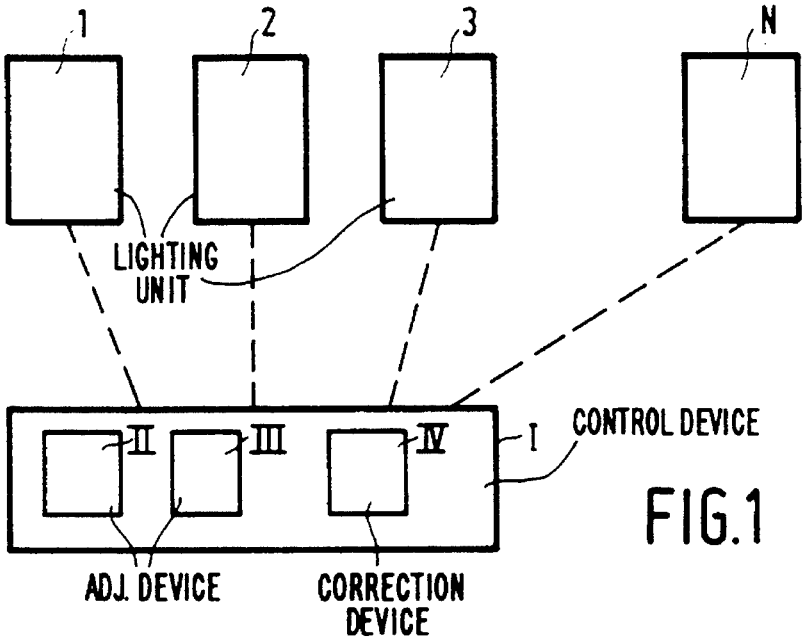
FIG. 1 is a diagram of an embodiment of a lighting system according to the invention.

In FIG. 1, reference numerals 1, 2, 3 . . . n denote lighting units forming part of the lighting system. Each lighting unit is provided with at least one lamp, an operating circuit for operating the lamp, and a control circuit for controlling the luminous flux of the lamp. The lighting units are coupled to control device I for influencing the luminous fluxes of the lamps through the respective control circuits. Control device I comprises first adjustment device II for selecting a lighting mode of the lighting system, further adjustment device III for changing a desired luminous flux value in at least one chosen location illuminated by at least one lighting unit of a first group of lighting units within a lighting mode. The control device I also comprise a correction device IV for automatic correction of the luminous fluxes of lighting units making up a second group of lighting units in dependence on a change in the desired luminous flux value in the chosen location.

The operation of the lighting system shown in FIG. 1 is as follows. When one or several users use a room in which the lighting system is installed, a user will set a lighting mode for the room with the first adjustment device. This selection of the lighting mode determines which lighting units belong to the first group of lighting units and which belong to the second group of lighting units. The luminous fluxes of all lighting units of the lighting system are also set for initial values belonging to the selected lighting mode. The lighting units of the first group produce luminous fluxes which are suitable, for example, for performing certain tasks in various chosen locations in the room, while the lighting units belonging to the second group produce luminous fluxes which realize a surround lighting which harmonizes with the task lighting referred to above. When one of the users of the room changes the desired luminous flux value in a chosen location, for example, to a higher value, the luminous fluxes of the lighting units of the second group are automatically changed by the correction device in such a manner that a good harmony between task lighting and surround lighting is maintained.

Figure 2:
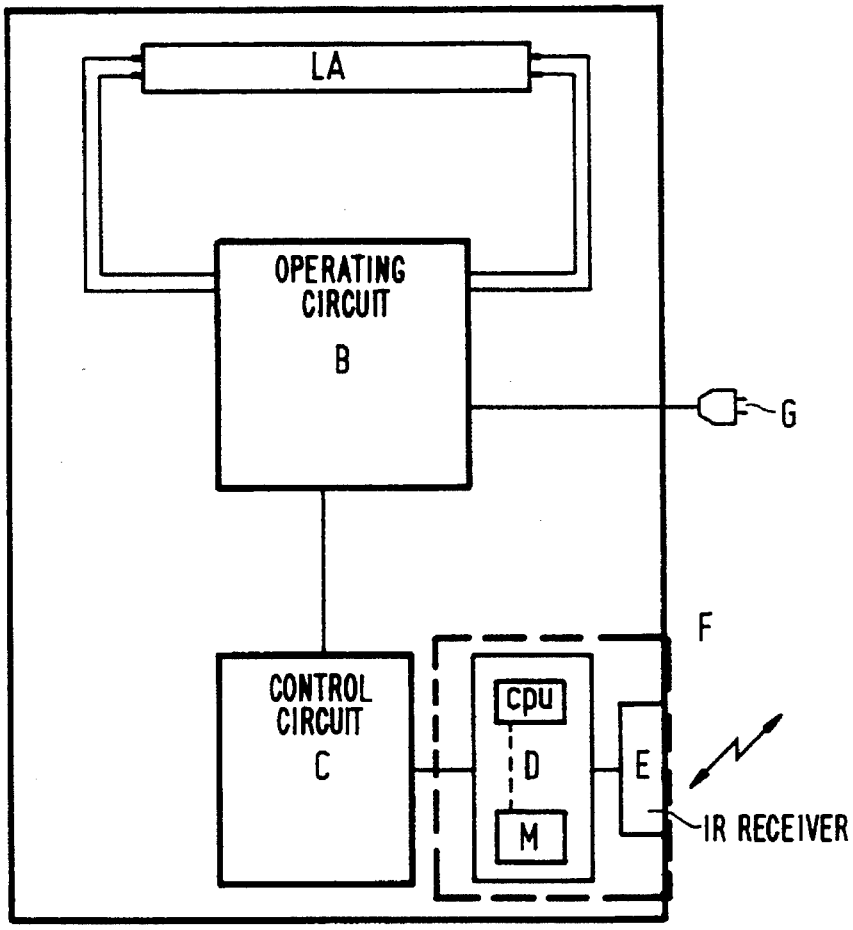
FIG. 2 shows an embodiment of a lighting unit and pan of the control means suitable for use in the lighting system shown in FIG. 1.

The portion of a lighting system shown in FIG. 2 is suitable for use in lighting systems according to the invention in which the control device comprises an infrared communication device. In FIG. 2, La is a lamp and B is an operating circuit coupled to the lamp La for operating the lamp La. Terminals G connect the lighting unit to a supply voltage source. C is a control circuit coupled to the operating circuit B for controlling the luminous flux of the lamp. E is an infrared receiver, D is a circuit for generating electrical signals which the circuit C is capable of interpreting and converting into control signals which are sent to the operating circuit B for changing the luminous flux of the lamp La, if so desired, through a change in the lamp operation. The circuit D comprises a memory M in which the chosen relation between the luminous fluxes of the lighting units of the first group and the luminous fluxes of the lighting units of the second group are laid down for each lighting mode. An initial luminous flux value for each lighting unit is also laid down in the memory M for each lighting mode. The circuit D also comprises a circuit CPU coupled to the memory M for generating the electrical signals mentioned above for controlling the luminous flux of the lamp in dependence on both the information present in the memory and the infrared signals received by the infrared receiver. The circuit CPU, using information contained in the infrared signal, also lays down in the memory which lighting mode was selected by the user(s) of the room and whether the relevant lighting unit belongs to the first or to the second group of lighting units in this lighting mode. If the lighting unit in question belongs to the first group, the circuit CPU also lays down in the memory which chosen location is illuminated by the lighting unit. The circuit D and the infrared receiver E form part of the first adjustment device in all lighting units; the circuit D and the infrared receiver E form part of the further adjustment device in lighting units which form the first group in the given lighting mode; the circuit D and the infrared receiver E form part of the correction device in lighting units which belong to the second group in the given lighting mode.

A lighting system comprising lighting units and a control device as shown in FIG. 2 as well as a further device for infrared communication operates as follows. When a user enters the room in which such a lighting system according to the invention is installed, the user can select a lighting mode for the room with the further infrared communication, device which may comprise, for example, an IR remote control. The signals transmitted by the IR remote control are received by the infrared receivers E of the control device and, as explained above, it is laid down by each circuit CPU in the memory coupled to the circuit CPU on the basis of the IR signals which chosen location is illuminated by the relevant lighting unit in the given lighting mode, and whether the relevant lighting unit belongs to the first or to the second group. The circuit CPU also sets the luminous flux of the relevant lighting unit for the initial value associated with the lighting mode. After selecting a lighting mode with the first adjustment means, the user may change the desired luminous flux in a chosen location by means of the further adjustment device, which is also incorporated in the IR remote control. The IR signals corresponding to this change are received by all infrared receivers E. The circuits CPU coupled to lighting units of the first group which do not illuminate the relevant chosen location can learn from the memory M that the information contained in the IR signals is not aimed at these lighting units, and they keep the luminous fluxes of these lighting units unchanged. The circuits CPU coupled to lighting units of the first group which do illuminate the relevant chosen location learn from the coupled memory M that the information contained in the IR signals is aimed at these lighting units, and increase or reduce the luminous fluxes of the lighting units in accordance with the user's wishes. The circuits CPU coupled to lighting units belonging to the second group learn from the memory that a change (if any) in the luminous fluxes of these latter lighting units is to be derived both from the desired luminous flux value in the chosen location changed by the infrared signals and from the relation between the luminous fluxes in the chosen locations on the one hand and the luminous fluxes of lighting units belonging to the second group on the other hand as laid down in the memory M.

A number of tables are stored in each memory M. The tables are arranged in series, the number of series being equal to the number of lighting modes in which the lighting unit coupled to the memory belongs to the second group. The number of tables in each series is equal to the number of chosen locations present in the room in the relevant lighting mode. In the first table of the first series of tables, each desired luminous flux value in a first chosen location is related to a first luminous flux range of the relevant lighting unit forming part of the second group of lighting units. Within this first range, the luminous flux of the relevant lighting unit is felt to be a pleasant surround lighting by a user present in the first chosen location for the given task lighting which is realized by the luminous flux in the first chosen location. The second table of the first series comprises a second luminous flux range of the relevant lighting unit within which this luminous flux is felt to be pleasant by a user present in a second chosen location for the same lighting mode for each desired luminous flux value in this second chosen location. There are a number of luminous flux values of the relevant lighting unit which lie both within the first range and within the second range for given luminous flux values at the first chosen location and at the second chosen location. If there are no more than two chosen locations in the room for the given lighting mode, the luminous flux of the relevant lighting unit belonging to the second group is set for one of these values by the circuit CPU via the control circuit C. If the lowest luminous flux value still forming part of both ranges is set by the circuit CPU, the contribution to the surround lighting formed by the luminous flux of the relevant lighting unit belonging to the second group is felt to be pleasant both by a user present in the first chosen location and by a user present in the second chosen location, while at the same time the power consumed by the lighting unit is comparatively low. If there are K chosen locations in the room in a selected lighting mode, the first series of tables comprises K tables which each contain a range for each desired luminous flux value at one of the K chosen locations within which the luminous flux of the relevant lighting unit is felt to be pleasant by a user present in the chosen location. The luminous flux of the relevant lighting unit of the second group is set for a value lying within all K ranges by the circuit CPU for given luminous fluxes at the chosen locations.

Another possibility is that each table in each series contains a value of the luminous flux of the relevant lighting unit only for one value of the desired luminous flux in the relevant chosen location. This luminous flux value of the relevant lighting unit is the lowest value for the luminous flux of the relevant lighting unit which lies within the range within which a user in the chosen location experiences the luminous flux of the relevant lighting unit as pleasant in the chosen location for a given luminous flux in the chosen location. All other values of the luminous flux of the relevant lighting unit for other luminous flux values in the chosen location are determined by the circuit CPU in that both the value of the desired luminous flux in the relevant chosen location and the accompanying luminous flux value of the relevant lighting unit are multiplied by the same factor. For a given setting of the desired luminous flux values in the chosen locations in a certain lighting mode, the luminous flux of each lighting unit of the second group is set by the circuit CPU for the highest value among the values which the circuit CPU calculates by means of the tables in the series. Since the values calculated by the circuit CPU by means of the tables in the series form the bottom limits of ranges within which the luminous flux of the relevant lighting unit of the second group is felt to be pleasant by the various users, it is practically always found in practice that the highest bottom limit falls within all ranges. When a lighting mode is selected with only one chosen location in such a lighting system, the luminous fluxes of the lighting units of the second group are changed by the same factor as the one by which a user changes the desired luminous flux value in the chosen location. When a lighting mode with more than one chosen location is selected, a change in the desired luminous flux in a chosen location will not always lead to a change in the luminous flux of each and every lighting unit of the second group because it is possible that the highest value selected by the circuit CPU remains unchanged. It is found in practice that the luminous fluxes of the lighting units of the second group are felt to be well attuned to the task lighting by every user of the room, also in lighting modes with more than one chosen location.

Figure 3:
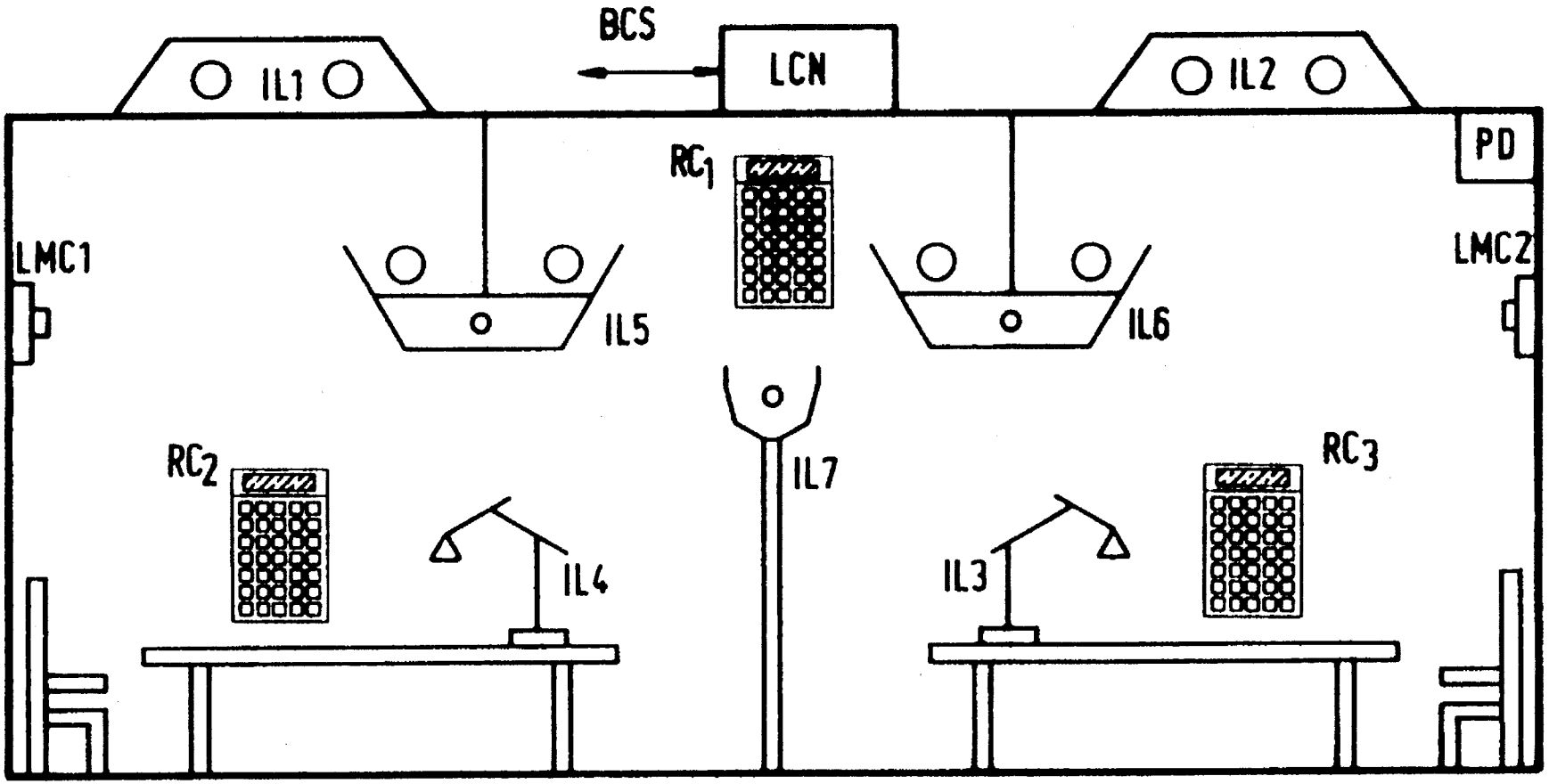
FIG. 3 is a diagrammatic picture of a room in which a lighting system according to the invention is present.

In FIG. 3, IL1 to IL7 denote lighting units. These lighting units are constructed as indicated in FIG. 2. Each lighting unit is coupled to an infrared receiver E and a circuit D, as shown in FIG. 2. The luminous flux of each of these lighting units can be set for a number of discrete values. In the lighting mode set, I13 and 1LA are lighting units associated with task lighting, and thus form the first group of lighting units. IL1, IL2, IL5, IL6 and IL7 form the second group of lighting units associated with surround lighting. RC1, RC2 and RC3 generate infrared signals, forming part of the control device for influencing the luminous fluxes of the lamps through the respective control circuits. RC1 together with the infrared receivers E and the circuit D forms a first adjustment device for selecting a lighting mode in the room. RC1 also comprises a programming device P1 for programming the desired relation between the desired luminous fluxes in the chosen locations and the luminous fluxes of the lighting units forming a part of the second group for each lighting mode of the lighting system, via the infrared receivers E and the circuits CPU, and comprises programming means P2 for assigning a lighting unit to one of the groups of lighting units. RC2 and RC3 together with the circuits D and the infrared receivers E, which are coupled to the lighting units of the first group, form the further adjustment device for changing the desired luminous flux value of one or several lighting units of the first group within a lighting mode. RC2 and RC3 together with the circuits D and infrared receivers E, which are coupled to the lighting units of the second group, in this embodiment form the correction device. The surfaces of the two tables present in the room and shown in FIG. 3 in this embodiment form the two chosen locations for the adjusted lighting mode. LMC1 and LMC2 are photometric cells which form part of a control system for keeping the total luminous flux at the desired level, which luminous flux is built up from the luminous flux of daylight and the luminous flux thrown by the lighting units associated with the task lighting onto the surfaces of the two tables present in the room and shown in FIG. 2, independently of the luminous flux of daylight. PD is a presence detector which forms a part of a presence detection system coupled to the control device for changing the lighting mode of the lighting system through the control device in the case in which nobody has been in the room for an adjustable time interval. LCN is a component of the system which is provided with repetition means for receiving infrared signals and subsequently transmitting them in an unchanged form. In addition, LCN comprises a device for communicating with a further control device for controlling the lighting of a group of rooms. This communication is depicted in FIG. 3 by a double-sided arrow touching the component LCN.

The operation of the lighting system shown in FIG. 3 is as follows. When a certain lighting mode has been selected with the first adjustment device, the lighting units IL1 to IL7 provide a spatial distribution of light associated with the relevant lighting mode. Luminous fluxes associated with task lighting are thrown onto the two table surfaces by the respective lighting units IL3 and IL4. As long as there are users in the room, the presence detector maintains the lighting mode of the lighting system. In addition to that, the control system comprising the photometric cells LMC1 and LMC2 controls the total luminous flux on each table surface at the desired value by increasing the luminous flux of lighting unit IL3 and of fighting unit HA when the luminous flux of daylight decreases, and by decreasing the luminous flux of lighting unit IL3 and of lighting unit IL4 when the luminous flux of daylight increases. The luminous fluxes of the lighting units IL1, IL2, IL5, IL6, and IL7, which form the second group of lighting units, are set so that a surround lighting felt to be pleasant by both users is realized. If the desired value for the total luminous flux on a table surface is changed by a user with the further adjustment device RC2 or RC3, the luminous flux of lighting unit IL3 or IL4 is changed. The circuits RCU then also adjust the luminous fluxes of the lighting units IL1, IL2 and IL5 to IL7 to a value fitting the changed task lighting through reference to the tables stored in the memories M. A relation between the task lighting and the surround lighting can be set upon (re)installation by means of the programming device P1 so as to fit the relevant task and the dimensions and arrangement of the room. It can be laid down by means of the programming means P2 which lighting units serve for task lighting and thus form pan of the first group of lighting units, and which lighting units serve for surround lighting and thus form part of the second group. The number of lighting units of the first or the second group can also be increased or reduced with the programming means P2.

We claim:

1. A lighting system comprising:

a plurality of lighting units, each provided with connection terminals for holding at least one lamp, an operating circuit for operating the lamp, and a control circuit coupled to the operating circuit for controlling the luminous flux of the lamp, and control means for adjusting the luminous fluxes of the lamps via the respective control circuits, comprising;

first adjustment means for selecting a lighting mode of the lighting system, further adjustment means for changing a desired luminous flux value within a lighting mode at at least one chosen location which is illuminated by at least one lighting unit included in a first group of the lighting units, and correction means for automatically changing the luminous fluxes of the lighting units included in a second group of lighting units which are located so as to illuminate a surround area and dependent upon a change in the desired luminous flux value of a lighting unit of the first group at the chosen location.

2. A lighting system as claimed in claim 1, further comprising a control system for rendering the total luminous flux made up of the luminous flux of daylight and of the luminous fluxes of the lighting units of the first group equal to the desired luminous flux value in the chosen location and independently of the luminous flux of daylight.

3. A lighting system as claimed in claim 1, wherein the correction means comprise a memory for storing a chosen relation between the desired luminous flux in the chosen location and the luminous fluxes of the lighting units of the second group for each lighting mode of the lighting system.

4. A lighting system as claimed in claim 3, wherein the memory comprises, for each lighting unit of the second group and for each desired luminous flux value in each chosen location, information concerning a luminous flux range of the lighting units of the second group, and the correction means include means for adjusting the luminous flux of each lighting unit of the second group to a value related to each of the luminous flux ranges of the lighting unit in the case of a change in the desired luminous flux value in a chosen location.

5. A lighting system as claimed in claim 4, wherein the correction means include means for determining the lowest luminous flux value of each lighting unit of the second group which falls within all luminous flux ranges of the lighting unit.

6. A lighting system as claimed in claim 1, wherein the luminous flux of each lighting unit can be set to a number of discrete values and the lighting system comprises at least first and second lighting modes in which the relative values of the luminous flux output of a light unit in the first group of lighting units and the luminous flux output of a light unit of the second group of lighting units are different and the total luminous flux output of the first and second groups of lighting units are different in said first and second lighting modes.

7. A lighting system as claimed in claim 1, wherein the control means comprise first programming means for programming a desired relation between the desired luminous flux at the chosen location and the luminous fluxes of the second group of lighting units for each lighting mode of the lighting system.

8. A lighting system as claimed in claim 7 wherein the control means comprise further programming means for selectively allocating a lighting unit to one of the first and second groups of lighting units.

9. A lighting system as claimed in claim 1, wherein the control means comprise infrared communication means and the spectral power distribution of the first group of lighting units does not have any special relationship to the spectral power distribution of the second group of lighting units.

10. A lighting system as claimed in claim 9, wherein the infrared communication means include repetition means for receiving infrared signals and for subsequently transmitting said signals in an unchanged form.

11. A lighting system as claimed in claim 1, wherein in that the control means include means for communication with further control means for controlling the illumination of a group of rooms.

12. A lighting system as claimed in claim 1, further comprising a presence detection system coupled to the control means for changing the lighting mode of the lighting system via the control means when nobody is present in the room for an adjustable time interval.

13. A lighting system for selectively lighting first and second chosen locations in a given enclosed area while automatically adjusting the lighting in a surround area of the enclosed area so as to harmonize the surround area lighting to that selected at said first and/or second chosen location, said lighting system comprising:

a first group of lighting units including at least first and second lighting units located in the vicinity of said first and second chosen locations, respectively, and with each lighting unit including at least one lamp, an operating circuit for the lamp and a control circuit coupled to its respective operating circuit for controlling the light output of its respective at least one lamp, a second group of lighting units located so as to illuminate the surround area of the enclosed area, and control means for adjusting the light output of the lamps in said first and second groups of lighting units, said control means comprising;

first adjustment means for selecting a lighting operating mode of the lighting system, further adjustment means for selectively controlling a desired light output of said first and second lighting units within a lighting mode thereby to selectively adjust the light output at at least one of said first and second chosen locations, and correction means for automatically controlling the light output of the second group of lighting units in response to an adjusted change in the light output at a chosen location and in a manner so as to harmonize the surround area lighting to that selected at said first and/or second locations.

14. The lighting system as claimed in claim 13 wherein daylight provides a part of the total light in said enclosed area, said lighting system further comprising;

a control system for controlling the light output of said lighting units so that the total light provided by the daylight and the light output of a lighting unit of the first group of lighting units is equal to the desired light at a chosen location and independently of the amount of daylight present.

15. The lighting system as claimed in claim 13 wherein the correction means comprises a memory for storing a variety of predetermined relationships between the desired light output at a chosen location and the light outputs of the lighting units of the second group of lighting units for each lighting mode of the lighting system.

16. The lighting system as claimed in claim 15, wherein the memory comprises, for each lighting unit of the second group and for each desired light output in each chosen location, information concerning a light output range of the lighting units of the second group, and the correction means include means for adjusting the light output of each lighting unit of the second group to a value related to each of the light output ranges of the lighting unit for a change in the desired light output at a chosen location.

17. The lighting system as claimed in claim 16 wherein the correction means include means for determining the lowest light output value of each lighting unit of the second group which falls within all light output ranges of the lighting unit.

18. The lighting system as claimed in claim 13 wherein the control means comprise first program means for programming a desired relationship between the desired light output at the chosen location and the light outputs of the second group of lighting units for each lighting mode of the lighting system.

19. The lighting system as claimed in claim 18 wherein the control means comprise further programming means for selectively allocating a lighting unit to the first and second groups of lighting units as a function of the selected lighting operating mode.

20. The lighting system as claimed in claim 1 wherein the control means comprise programming means for selectively allocating at least one lighting unit to the first or second group of lighting units dependent upon the selected lighting mode.

21. The lighting system as claimed in claim 1 wherein said one lighting unit of the first group is located in the vicinity of the one chosen location and the second group of lighting units are located at positions substantially different from those at which the first group of lighting units are located.

* * * * *